US007021011B2

(12) United States Patent
Mian et al.

(10) Patent No.: US 7,021,011 B2
(45) Date of Patent: Apr. 4, 2006

(54) DECORATIVE LUMINOUS PANEL ASSEMBLY AND ITS SUPPORT

(75) Inventors: Alec Mian, Barcelona (ES); Julie Callahan, Palmer, MA (US)

(73) Assignee: La Evolucion Barcelona, S.L., Barcelona (ES)

( * ) Notice: Subject to any disclaimer, the term of this patent is extended or adjusted under 35 U.S.C. 154(b) by 0 days.

(21) Appl. No.: 11/088,043

(22) Filed: Mar. 23, 2005

(65) Prior Publication Data

US 2005/0183355 A1 Aug. 25, 2005

Related U.S. Application Data

(63) Continuation of application No. PCT/ES03/000495, filed on Oct. 1, 2003.

(30) Foreign Application Priority Data

Oct. 2, 2002 (ES) ..... 200202237

(51) Int. Cl.
*E06B 7/00* (2006.01)

(52) U.S. Cl. ..... 52/171.3; 40/541

(58) Field of Classification Search ..... 52/171.3, 52/235, 202, 712; 40/541, 542
See application file for complete search history.

(56) References Cited

U.S. PATENT DOCUMENTS

| | | | | |
|---|---|---|---|---|
| 4,860,475 | A * | 8/1989 | Levy et al. | 40/547 |
| 4,905,569 | A * | 3/1990 | Seksaria et al. | 89/36.02 |
| 4,917,448 | A * | 4/1990 | Oppenheimer | 385/116 |
| 5,184,253 | A * | 2/1993 | Hwang | 359/889 |
| 5,787,662 | A * | 8/1998 | Danz | 52/235 |
| 6,092,777 | A | 7/2000 | Kuntz | |
| 6,341,879 | B1 | 1/2002 | Skinner et al. | |
| 6,955,026 | B1 * | 10/2005 | Misonou | 52/786.13 |

FOREIGN PATENT DOCUMENTS

| | | |
|---|---|---|
| GB | 1015328 | 12/1965 |

* cited by examiner

*Primary Examiner*—Naoko Slack
(74) *Attorney, Agent, or Firm*—Darby & Darby

(57) ABSTRACT

The decorative luminous panel assembly and its support comprises a panel of translucent synthetic material bearing decorative designs and capable of receiving the illumination from a light source incorporated in the support, said panel carrying a plurality of thread-like elements of transparent synthetic material, fixed by one end to the panel at the rear face thereof, that is to say, on the unseen face, and which are capable of being fixed by the other end on the support, the rear face of the panel making firm contact against a plurality of supporting appendages of the support, which have a very pointed end, so that the contact with the panel occurs on an extraordinarily reduced surface, practically invisible from the exposed side of the translucent panel.

8 Claims, 4 Drawing Sheets

DECORATIVE LUMINOUS PANEL ASSEMBLY AND ITS SUPPORT

CROSS REFERENCE TO PRIOR APPLICATION

This application is a continuation of International Patent Application Serial No. PCT/ES2003/000495, filed Oct. 1, 2003, which published in Spanish on Apr. 15, 2004 as WO 2004/032102, and is incorporated herein by reference in its entirety.

The present invention relates to a decorative luminous panel assembly and its support, which provides appreciable characteristics of novelty and inventive step in this sector of the art.

Basically, the present invention is intended to disclose a decorative luminous panel of the type constituted by a laminar mass of one or more layers of a translucent synthetic material which, according to the present invention, has means for its suspension, from a roof, wall or shelf, without said means being noticeable from outside the panel, producing a new and very attractive aesthetic impression, since it is possible to look upon the decorative luminous panel which has the desired designs, with a uniform level of illumination, providing a diffuse illumination of equal intensity over the whole extent of the panel, which gives the impression of being suspended in the air without points of attachment to the wall, roof or other surface to which it can be connected.

It is a feature of the present invention that the decorative panel of translucent synthetic material has inserted into it, fixed by adhesive means or in some other way, one end of each of a plurality of thread-like elements, made of a completely transparent synthetic material, which allow it to be fixed to a suspension support in which it is characteristic that the points of contact between the support and panel occur at the ends of pointed supporting means ending in a sharp point, providing a point of contact between the supporting means and the decorative luminous panel of such reduced dimensions that they are not visible once the panel is illuminated from the rear, therefore producing an impression of the decorative panel being suspended in the air. The pointed supporting means are incorporated in a suspension assembly for suspension on the desired surface which includes a base for connection to the surface, a light source and a diffuser plate for evening out the luminous flux to the decorative panel. If required, a smooth plate may be incorporated between the attachment base and the light source in order to render uniform and increase the reflection of the light from said light source to the decorative panel.

The ends of the thread-like elements which are inserted in the mass of the decorative panel will have small heads obtained by the most convenient method, in order to improve the anchorage within the panel and, at the opposite ends, they may have means for attachment to the suspension support, for example, small thickenings intended to be gripped in grooves of the support, which may optionally, in order to simplify the production of the support, be formed on the actual points of support of the panel.

For greater understanding thereof, by way of non-limiting explanatory example, some drawings showing preferred embodiments of the present invention are appended hereto.

Figure 1:
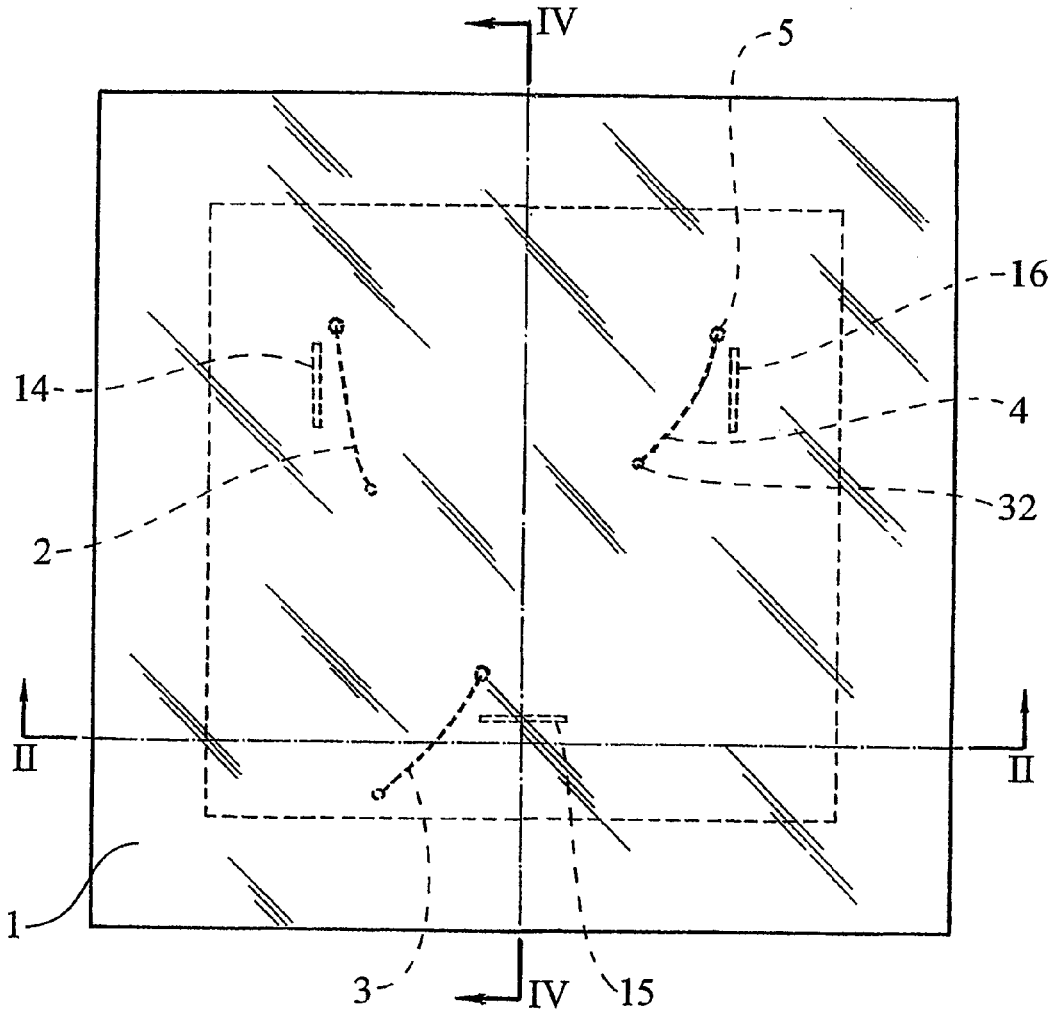
FIG. 1 shows a plan view of a decorative panel according to the present invention.
Figure 3:
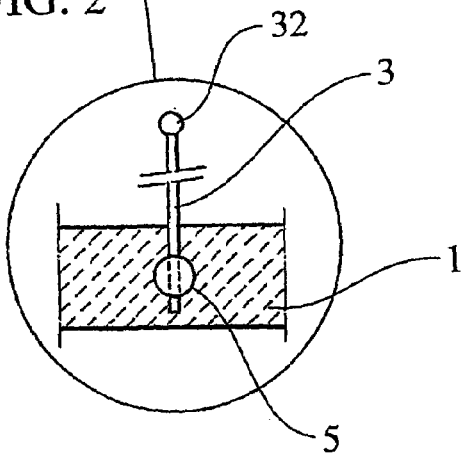
FIG. 3 shows a detail in section.
Figure 5:
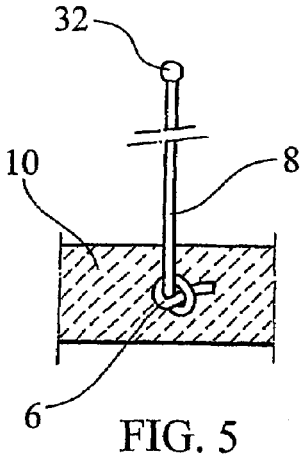
FIGS. 5 and 6 show sections illustrating variants of the form of anchorage of the thread-like elements in the decorative luminous panel.
Figure 6:
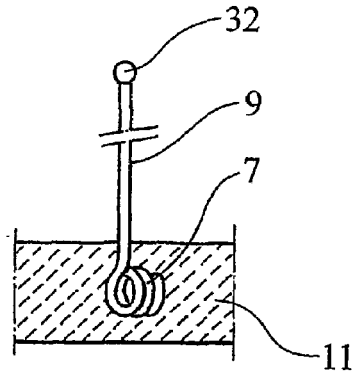

As shown in the drawings, the assembly of the present invention comprises a panel 1 made of a translucent synthetic material, which may bear different types of decoration and/or other types of graphic designs, having fixed on it the ends of thread-like suspension elements variable in number, for example the three elements indicated by dashed lines in FIG. 1, designated by the numerals 2, 3 and 4, which elements are composed of completely transparent synthetic material, being fixed by their ends to the panel 1, for example, by the insertion of the ends of said thread-like elements in the mass of the panel 1 in which they are rigidly secured, as may be observed by way of example in FIG. 3, in which can be seen the thread-like element 3 introduced by its end into the mass of the panel 1, in which it is retained by the insertion of its end 5 of somewhat larger dimensions, which permits easy retention of the end of said thread-like element. The shape of said thickened end or head 5 may be variable, and it may be a small mass of spherical or other shape, or a knotting of one end, as may be observed in FIGS. 5 and 6, in which can be seen the variations of knots 6 and 7 on the ends of thread-like elements 8 and 9 of the type indicated previously, which are retained in the mass of the panel, as shown by the numerals 10 and 11 in the figures.

Figure 2:
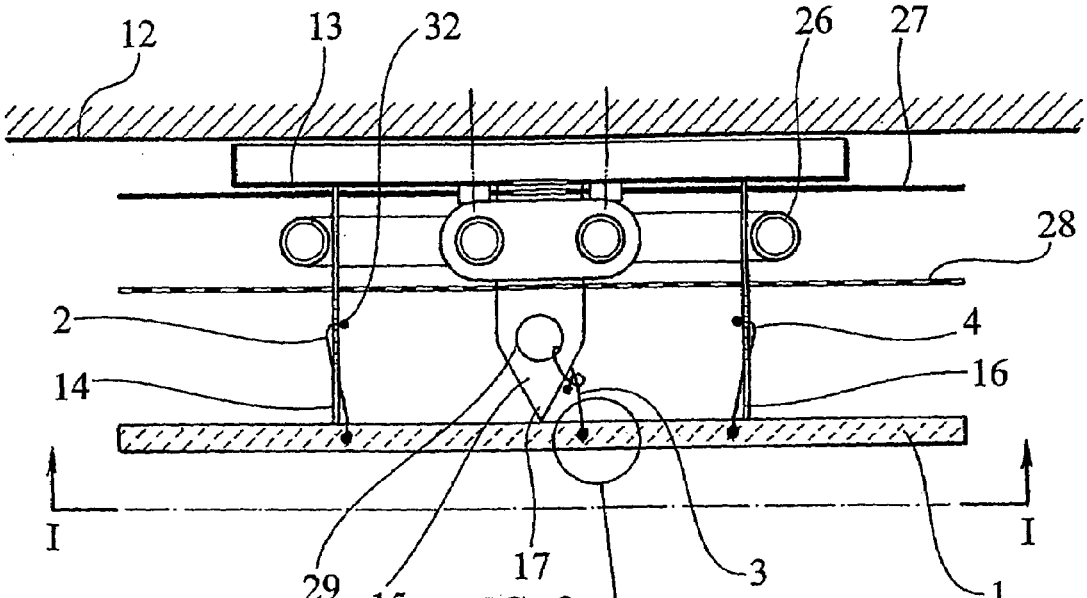
FIG. 2 shows a cross section of the decorative luminous panel assembly and support of the present invention.
Figure 4:
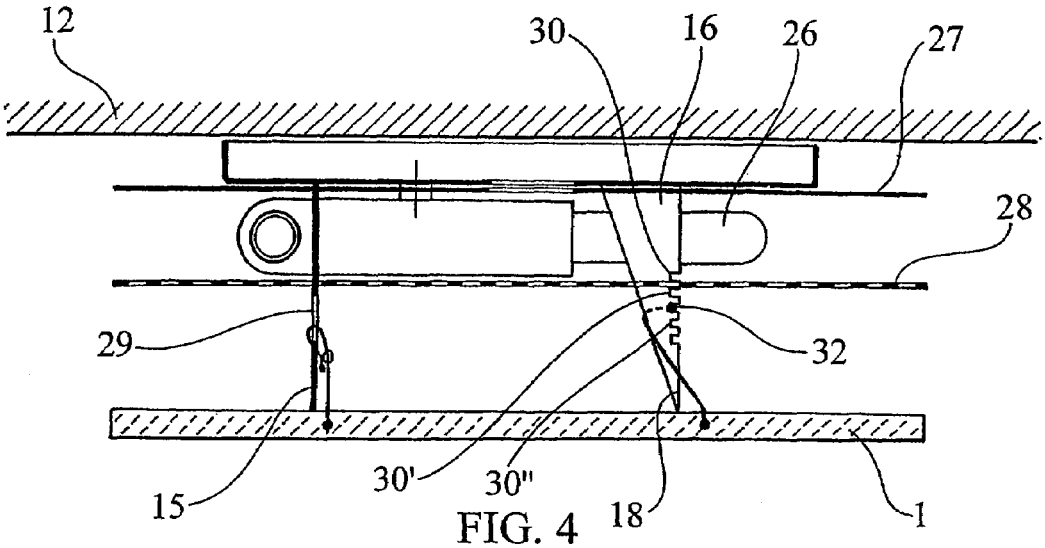
FIG. 4 shows a section through the section plane indicated of the assembly in FIG. 2.

The assembly which constitutes the present invention comprises a fixing support for fixing to the roof or other surface, such as that indicated by the numeral 12, having variable means for said attachment, there being shown in FIG. 2 a support which is embodied by a base 13 applied directly and fixed to the surface 12 and which carries supporting means for the panel 1 equal in number to the thread-like elements 2, 3 and 4, being indicated in the drawings by the numerals 14, 15 and 16. It is a feature of said supporting means that they end in a very pointed shape, as can be seen from the pointed ends 17 and 18 shown in FIGS. 2 and 4. By means of said very pointed structure, the result obtained is that the contact between the decorative panel 1 and the supporting means mentioned is of extraordinarily reduced dimensions, so that they are not noticeable from the show face of the decorative luminous panel 1.

Figure 7:
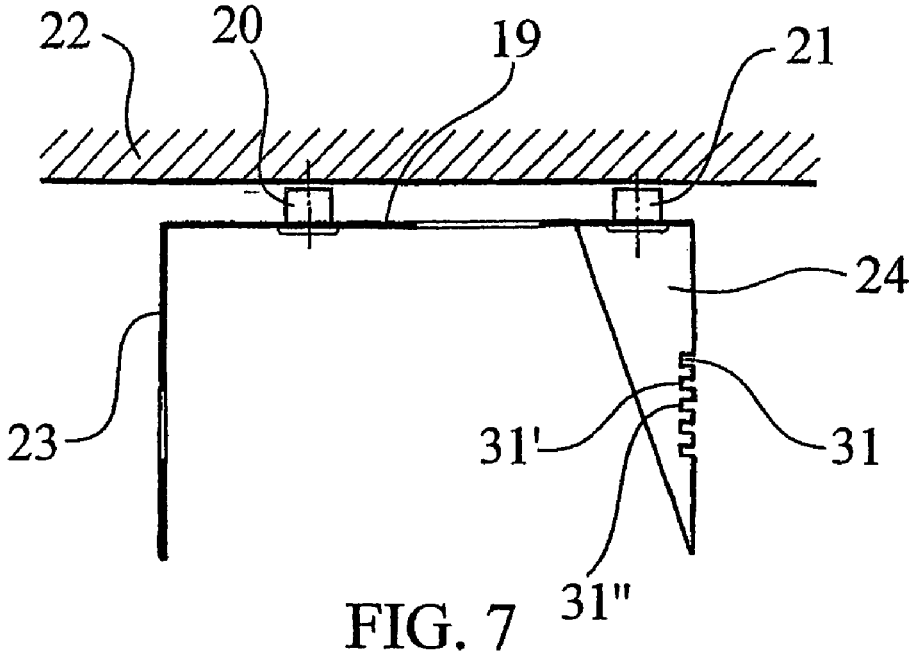
FIG. 7 shows another detail according to the section plane shown in FIG. 8.
Figure 8:
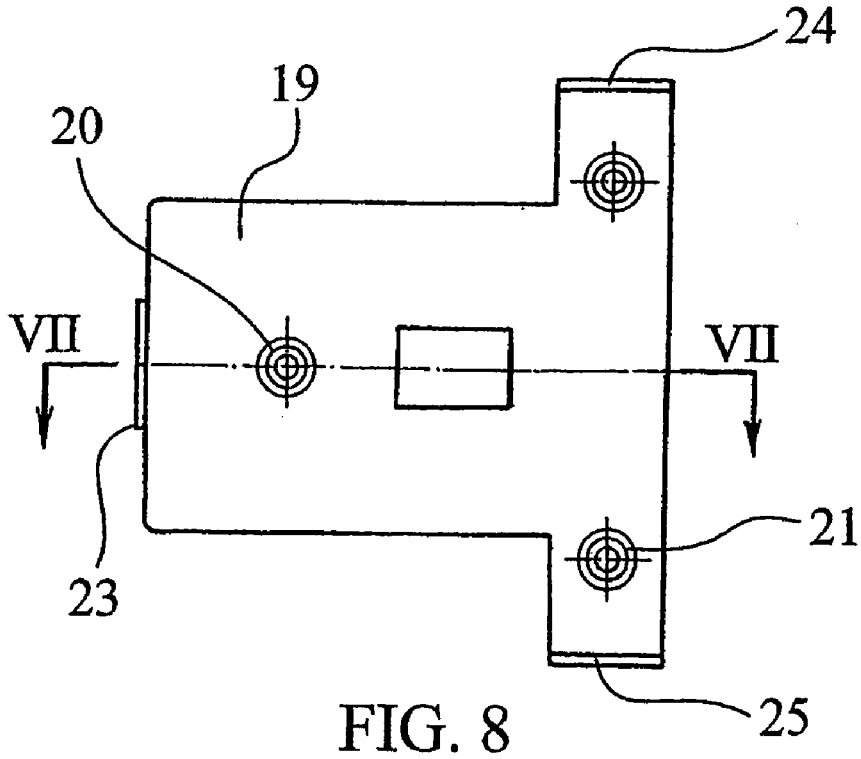
FIG. 8 shows a plan view of a variant of the support of the panel.

The supporting means 14, 15 and 16 may be integral with the base 13 or, in the variant shown in FIGS. 7 and 8, may be incorporated in a plate 19 equipped with abutments such as those indicated by the numerals 20 and 21 to prevent its direct contact with the surface 22 and being fixed thereto in various ways, being able to be provided by stamping and bending with the supporting means 23, 24 and 25 which have the pointed end mentioned previously.

The support will comprise a light source 26, for example a neon tube of the desired shape to obtain the greatest possible evenness in the luminous flux intended to impinge on the rear face of the panel 1. In order to improve the light output of the light source 26, the support may include a reflective plate 27 having an extent similar to the support assembly, which will be completed by a diffuser plate 28 intended to obtain the greatest possible evenness of luminous flux to the panel 21.

By means of the assembly of means that has been explained, it is possible to constitute a decorative luminous panel assembly and corresponding support, which makes it possible to obtain a new and original effect in that it permits the display of the luminous panel bearing decorative designs and/or legends of the desired type, with an extraordinary aesthetic effect by exhibiting a light distribution of equal intensity over its whole extent and without points of suspension showing, thereby giving the impression that the luminous panel is actually suspended in the air, since the means of suspension are not visible.

The upper ends of the thread-like elements will be fixed the support by any suitable method, for example by retention or knotting in openings 29 or in series of grooves 30, 30', 30" and 31, 31', 31", which, as in the drawings, may be provided in the actual supporting means 23, 24 and 25. In order to facilitate their retention, the upper ends of the thread-like elements may include thickenings such as that indicated by the numeral 32 in the drawings.

What is claimed is:

1. A decorative luminous panel assembly and its support, characterized in that it comprises a panel of translucent synthetic material bearing decorative designs and capable of receiving the illumination from a light source incorporated in the support, said panel carrying a plurality of thread-like elements of transparent synthetic material, fixed by one end to the panel at the rear face thereof, that is to say, on the unseen face, and which are capable of being fixed by the other end on the support, the rear face of the panel making firm contact against a plurality of supporting appendages of the support, which have a very pointed end, so that the contact with the panel occurs on an extraordinarily reduced surface, practically invisible from the exposed side of the translucent panel.

2. A decorative luminous panel assembly and its support according to claim 1, characterized in that the transparent thread-like elements are fixed to the translucent panel by the insertion of their ends in the mass of said panel, during the stage of moulding thereof.

3. A decorative luminous panel assembly and its support according to claim 1, characterized in that the ends of the transparent thread-like elements which are inserted in the panel have retaining thickenings at their ends.

4. A decorative luminous panel assembly and its support according to claim 1, characterized in that the ends of the transparent thread-like elements which are fixed to the support have thickenings to facilitate their retention on the support.

5. A decorative luminous panel assembly and its support according to claim 1, characterized in that the transparent thread-like elements are retained in one of the plurality of series of retaining grooves of the support assembly for the translucent panel.

6. A decorative luminous panel assembly and its support according to claim 1, characterized in that the retaining grooves for retaining the ends of the thread-like elements are formed in the pointed supporting means themselves.

7. A decorative luminous panel assembly and its support according to claim 1, characterized in that the fixing support for fixing to the surface bearing the assembly has a reflective plate located above the light source in order to improve the output of the illumination of the rear face of the decorative panel.

8. A decorative luminous panel assembly and its support according to claim 1, characterized by the arrangement of a diffuser plate between the light source and the rear face of the translucent panel to even out the luminous flux for illumination of said panel.

* * * * *